United States Patent [19]

Stucky

[11] 3,992,848

[45] Nov. 23, 1976

[54] BUILDINGS

[75] Inventor: Fritz Christoph Stucky, Zug, Switzerland

[73] Assignee: Credelca A.G., Zug, Switzerland

[22] Filed: May 24, 1974

[21] Appl. No.: 473,191

[30] Foreign Application Priority Data

May 25, 1973 United Kingdom ..... 25091/73

[52] U.S. Cl. ..... 52/745; 52/79; 52/227; 52/236; 52/241

[51] Int. Cl.[2] ..... E04G 21/04

[58] Field of Search ..... 52/79, 745, 747, 236, 52/227, 610, 241

[56] References Cited

UNITED STATES PATENTS

| | | | |
|---|---|---|---|
| 2,105,588 | 1/1938 | Davis | 52/241 |
| 3,189,135 | 6/1965 | Slowinski | 52/241 |
| 3,460,308 | 8/1969 | Stucky | 52/747 |
| 3,503,170 | 3/1970 | Shelley | 52/79 |
| 3,538,658 | 11/1970 | Lavalley et al. | 52/241 X |
| 3,540,173 | 11/1970 | Johnides | 52/79 |
| 3,568,380 | 3/1971 | Stucky | 52/79 |
| 3,616,592 | 11/1971 | Rothman | 52/745 |
| 3,643,814 | 2/1972 | Martin | 52/79 X |
| 3,712,008 | 1/1973 | Georgiev | 52/79 |
| 3,822,569 | 7/1974 | Lautrup et al. | 52/79 |
| 3,823,520 | 7/1974 | Ohta et al. | 52/79 X |
| 3,832,811 | 9/1974 | Briel, Jr. | 52/79 X |
| 3,834,110 | 9/1974 | Vercelletto | 52/79 X |

FOREIGN PATENTS OR APPLICATIONS

| | | | |
|---|---|---|---|
| 269,000 | 2/1964 | Australia | 52/79 |
| 684,712 | 7/1966 | Belgium | 52/79 |
| 1,168,484 | 1/1957 | France | 52/79 |
| 1,178,787 | 5/1959 | France | 52/79 |
| 915,629 | 11/1946 | France | 52/227 |
| 1,269,080 | 7/1961 | France | 52/79 |
| 1,452,292 | 8/1966 | France | 52/745 |
| 1,259,041 | 3/1961 | France | 52/745 |
| 639,437 | 2/1960 | Italy | 52/79 |
| 1,194,372 | 6/1970 | United Kingdom | 52/79 |
| 1,067,888 | 5/1967 | United Kingdom | 52/79 |

*Primary Examiner*—Price C. Faw, Jr.
*Assistant Examiner*—Leslie Braun
*Attorney, Agent, or Firm*—Brumbaugh, Graves, Donohue & Raymond

[57] ABSTRACT

A prefabricated transportable room element for use in the erection of a building comprising a plurality of such room elements, said room element forming a load-bearing unit and comprising a load bearing frame or chassis consisting of a load-bearing floor panel structure and at least one load-bearing vertical structure, and at least one prefabricated, self-supporting cell unit incorporating such electrical, plumbing, gas and like installations as would normally be present in that region of a finished building, said unit being factory assembled with said load-bearing frame or chassis to form a room element ready for transport.

8 Claims, 11 Drawing Figures

BUILDINGS

Figure 1:
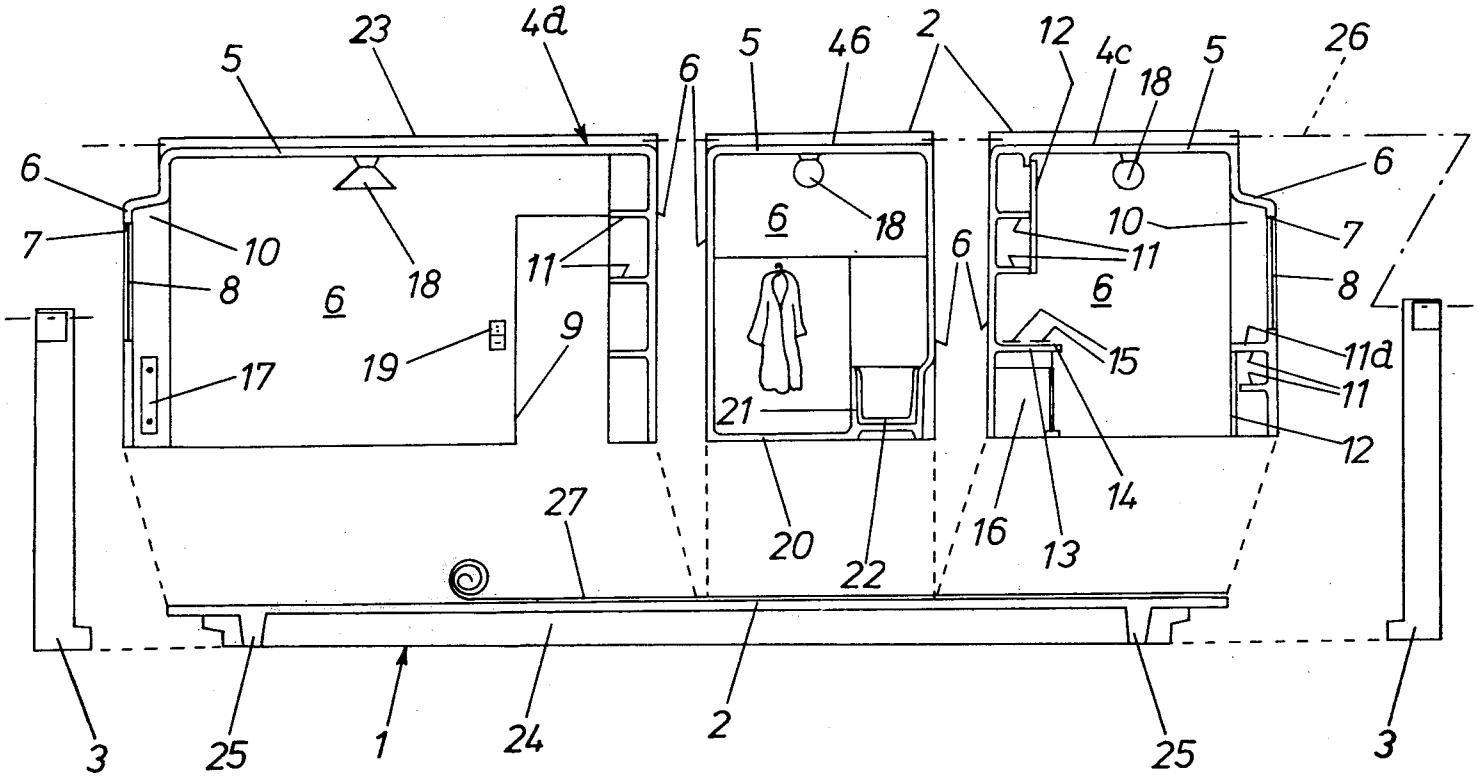

This invention relates to buildings and specifically to transportable prefabricated room elements for erection into a single storey, or a plural storey, building.

The expression "transportable prefabricated room element" is employed herein to define a transportable prefabricated cell-like structure having two opposed sides and two opposed ends constituting four faces of the cell and comprising a floor panel structure and a load-bearing vertical structure rigidly connected to the floor panel structure (e.g., at or adjacent to one of said faces) for supporting parts of the building (such for example, as a roof or ceiling or the floor panel structure of a super-imposed room element) extending over and positioned above the floor panel structure, which element is adapted to be mounted face-to-face with a further such element in building up a storey, or part of a storey, of a building from a plurality of such elements. The expression "face-to-face" includes side-by-side, end-to-end, and end-to-side. The expression "load bearing vertical structure" includes a vertical load-bearing wall and spaced vertical load-bearing columns. The said columns may support fill-in panelling to close, or partly close, a face of the structure, and the expression "fill-in panelling" includes a wall panel, a door, or a window, and in the case of a wall panel the latter may be integral with the two columns between which it extends or may be attached to them. Such room elements and buildings incorporating them form the subject of British Patent Nos. 1,101,597, 1,101,385, 1,068,172, 1,027,241, 1,027,242, 1,034,101, 1,250,883, and 1,271,024 to which reference may be made for further particulars.

It has been proposed to fabricate such room elements on the basis of a load-bearing frame or chassis which consists of initially separate components, viz, a reinforced floor panel structure and reinforced load-bearing vertical end structures, the latter being rigidly connected to opposite ends of the panel.

Such room elements are intended to be fabricated in a substantially complete manner at a factory remote from the building site. In particular such electrical wiring, plumbing and heating installations, doors, partitions, glazing and interior finish, as are required in the complete building are applied to the room elements at the factory so as to bring them to a substantially finished condition. The room elements are then transported to the building site and there assembled into a building to which only the minimum finishing work such for example as concealing joint lines needs to be carried out.

The ceiling or roof, some or all of the side walls and any interior partition walls of such room elements have hitherto been fabricated by conventional building methods whilst the room elements are travelling along a production line. Conventional building methods are not compatible with modern factory production techniques and this, with the limited access for workmen which renders it difficult for more than one team to work at a time, has meant that progress along the production line has been slow and the advantages of fully industrialized production have not been realized.

The present invention provides a prefabricated transportable room element for use in the erection of a building comprising a plurality of such room elements, said room element forming a load-bearing unit and comprising a load-bearing frame or chassis consisting of a load-bearing floor panel structure and at least one load-bearing vertical structure, and at least one prefabricated self-supporting cell unit incorporating installations as herein defined, which unit is factory assembled with said load-bearing frame or chassis to form a room element ready for transport.

The present invention also provides a transportable prefabricated room element as hereinbefore defined, comprising (a) a load-bearing frame or chassis comprising a floor panel structure and at least one load-bearing vertical structure, and (b) at least one cell unit assembled with the load-bearing frame or chassis, the cell unit being prefabricated prior to assembly with the load-bearing frame or chassis and comprising a ceiling or roof forming at least part of the ceiling or roof of the room element and at least one wall depending from the ceiling or roof and forming at least part of a vertical wall of the room element. The or each cell unit may incorporate installations as herein defined.

The expression "installations" as used herein and in the claims hereof means any or all of the following, viz: pipes and conduits for services, such as water, electricity and gas, and/or required fixtures and fittings, such as electric junction boxes and electric switches, or channels or recesses for the reception of such pipes or conduits and/or required fixtures and fittings, passages for post-tensioning cables or other structural means, and decorative surfacing materials or surface finishes.

The present invention further provides a method of forming a transportable prefabricated room element as hereinbefore defined, the method comprising (a) taking a prefabricated load-bearing frame or chassis comprising a floor panel structure and at least one load-bearing vertical structure, (b) taking at least one prefabricated cell unit comprising a ceiling or roof and at least one wall depending from the ceiling or roof, and (c) assembling the cell unit with the load-bearing frame or chassis so that the ceiling or roof of the cell unit forms at least part of the ceiling or roof of the room element and so that said at least one depending wall forms at least part of a vertical wall of the room element.

The invention further provides a building having at least one storey comprising a plurality of room elements according to the present invention mounted face-to-face.

The room element may comprise a single said cell unit the roof or ceiling of which comprises the roof or ceiling of the room element or may comprise a plurality of said cell units the roof or ceiling of each of which comprises a part of the roof or ceiling of the roof element. The or each cell unit may be open at the bottom.

The or each cell unit may comprise a roof or ceiling and at least one vertical load bearing part. The term "load bearing part", in relation to the or a unit, means a vertical wall or structure which at least assists in supporting the roof or ceiling of that unit in the prefabricated condition of the unit.

The or each said cell unit may comprise some or all of the non-load-bearing vertical walls of the room element or a region thereof.

The or each unit may be assembled from separately formed, e.g., cast, elements. Alternatively, the or each said wall of the cell unit may be formed integrally with the ceiling or roof thereof, e.g., as by casting, moulding or extruding the cell unit. The cell unit may be formed from a fireproof castable building material which is dimensionally stable or expands only very slightly during curing and which exhibits no or only very slight overall shrinkage after curing. A suitable building material for the cell unit comprises a suitable mixture of plaster (e.g., gypsum plaster and lime plaster), cement and aggregate such as that sold by Societe Lafarge of France under the name "Liant 45."

The floor panel structure and the vertical load-bearing structure or structures of the load-bearing frame or chassis may be formed from reinforced concrete. The vertical load-bearing structure or structures, of which there are preferably two located at or spaced inwards from opposite ends of the floor panel structure, may be formed integrally with or separately from the floor panel structure. Alternatively or in addition, one or more vertical load-bearing structures may be provided intermediate the ends of the floor panel structure. The floor panel structure, which may be prefabricated, may comprise a single floor panel of the required size or may comprise a plurality of floor panel sections rigidly connected in an edge-to-edge assembly by suitable structural means such as post-tensioning means. Where the or each vertical load-bearing structure is formed separately from the floor panel structure, the vertical load-bearing structure or structures may be assembled with the floor panel structures either prior to or subsequent to the assembly of the cell unit(s) with the floor panel structure. The vertical load-bearing structure or structures are preferably substantially of room height.

The floor panel structure may comprise one or more non-load bearing vertical walls, e.g., so that in the finished room element some non-load bearing walls are provided by the floor panel structure and some by the cell unit or units.

Where the room element comprises a plurality of cell units, the cell units may be connected together in assembled relationship as by post-tensioning or other suitable means prior to assembly with the load-bearing frame or chassis. Alternatively, the cell units may be assembled with the load-bearing frame or chassis and then connected together and to the vertical load bearing structure(s) of the load-bearing frame or chassis as by post-tensioning or other suitable means. Each cell unit may be provided with a portion of the post-tensioning means and said portions may be coupled together during assembly.

Decorative surfacing materials, e.g., plastics wallcoverings, may be applied to the walls and/or ceiling or roof of the cell units during casting, as by lining the mould with such surfacing material. The provision of such a decorative surfacing material during casting can serve not only to reduce the amount of finishing subsequently required but also to facilitate the removal of the cell unit from the mould because, particularly where plastics wallcoverings are used, the decorative surfacing material prevents the building material from which the cell unit is cast from adhering to the mould. Where a decorative surfacing material is provided, then this is preferably covered with a protective film or layer, e.g., of plastics, paper or the like, which can readily be removed when all work on the room element or on the building in which it is incorporated and which is likely to soil or damage the surfacing material has been completed.

The or each cell unit may comprise at least one vertical wall member which stands on and is fastened to the floor panel structure. For example, the or a vertical wall member of the or each cell unit may be received in a fixture in or on the floor panel structure. A sound insulating, elastic filler may be provided between the lower edge of the or a vertical wall member of the or each cell unit and the floor panel structure. Thus, to conceal the joints between the wall or walls of the or each cell unit and the floor panel structure of the load-bearing frame or chassis, channel-section means may be provided which can be secured to the upper surface of the floor panel structure and which is adapted to receive the lower margin of the or each said wall. The channel-section means may be of metal, plastics or other suitable material and may comprise a bottom wall which can be secured, e.g., bolted or adhered, to the upper surface of the floor panel structure and upstanding side walls between which the lower margin of the or a said wall is received. The lower margin of the or each said wall may be chamferred to facilitate the engagement thereof with the channel-section means. A suitable bonding or sealing material may be provided between the channel-section means and the lower margin of the or a said wall which is engaged in the channel-section means. Thus a quantity of bonding or sealing material may be provided in the bottom of the channel-section means prior to the engagement of the or a said wall therein so that when the lower margin of the or a said wall is inserted therein the bonding or sealing material will be displaced around the lower margin of the wall. The bonding or sealing material may be such as to provide a rigid joint on curing, e.g., may be a cement mortar, or may be such as to provide some elasticity in the joint on curing, e.g., may be a rubber or plastics based compound.

The dimensions of the room element may conform to the standard for transportable containers which, at present, is 40 feet (12.15m) in length and 8 feet (2.43m) in width. The height is not critical but may be 8 feet.

The cell unit may be a bathroom unit, a staircase unit, a heating unit, an elevator shaft unit, a kitchen unit, or any other region of a room element which is capable of being prefabricated as a unit. Alternatively the cell unit may comprise different regions, e.g., a bathroom region, a kitchen region, a staircase region, etc.

Where the cell unit is a "wet" cell unit or comprises a "wet" region, e.g., is a bathroom or cloakroom cell unit or comprising a bathroom or cloakroom region, then the wet cell unit or wet region may further comprise a floor portion which rests on the floor panel structure of the load bearing frame or chassis and is adapted to prevent leakage of water from the wet cell unit or wet region to adjacent cell units or adjacent regions.

Figure 2:
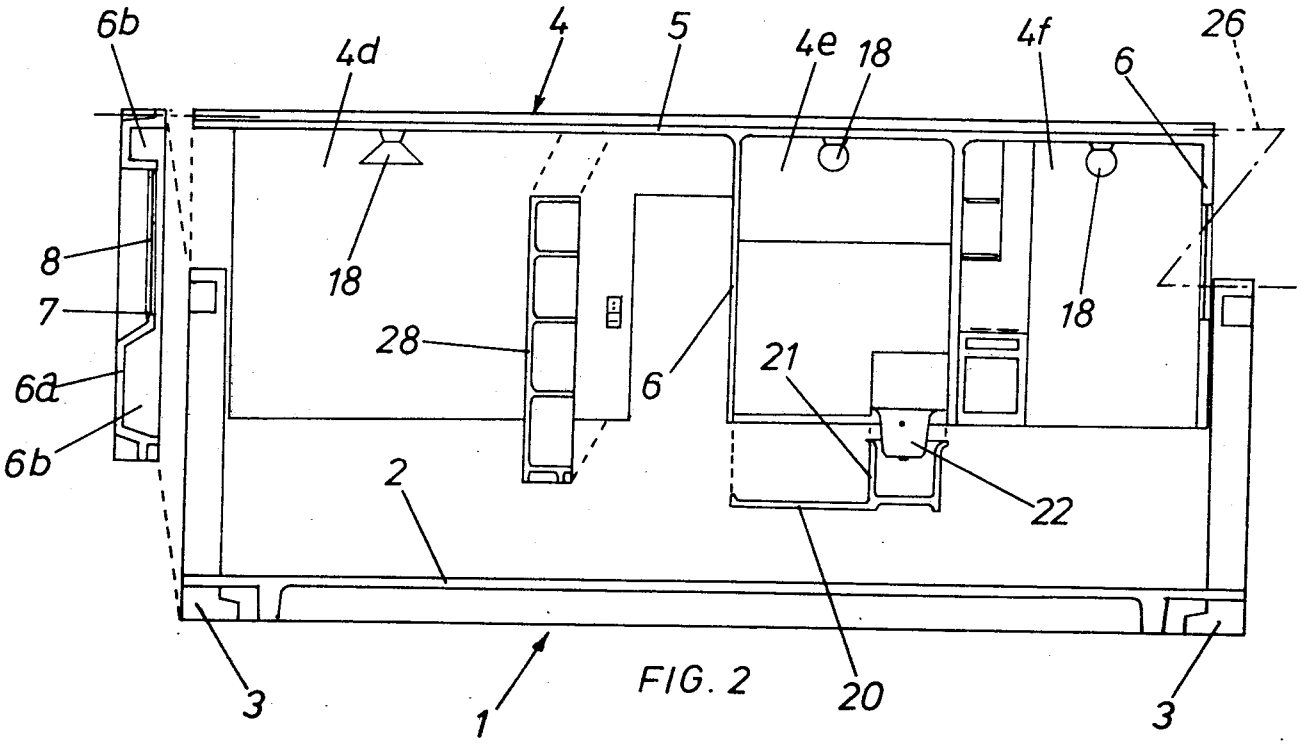
Figure 3:
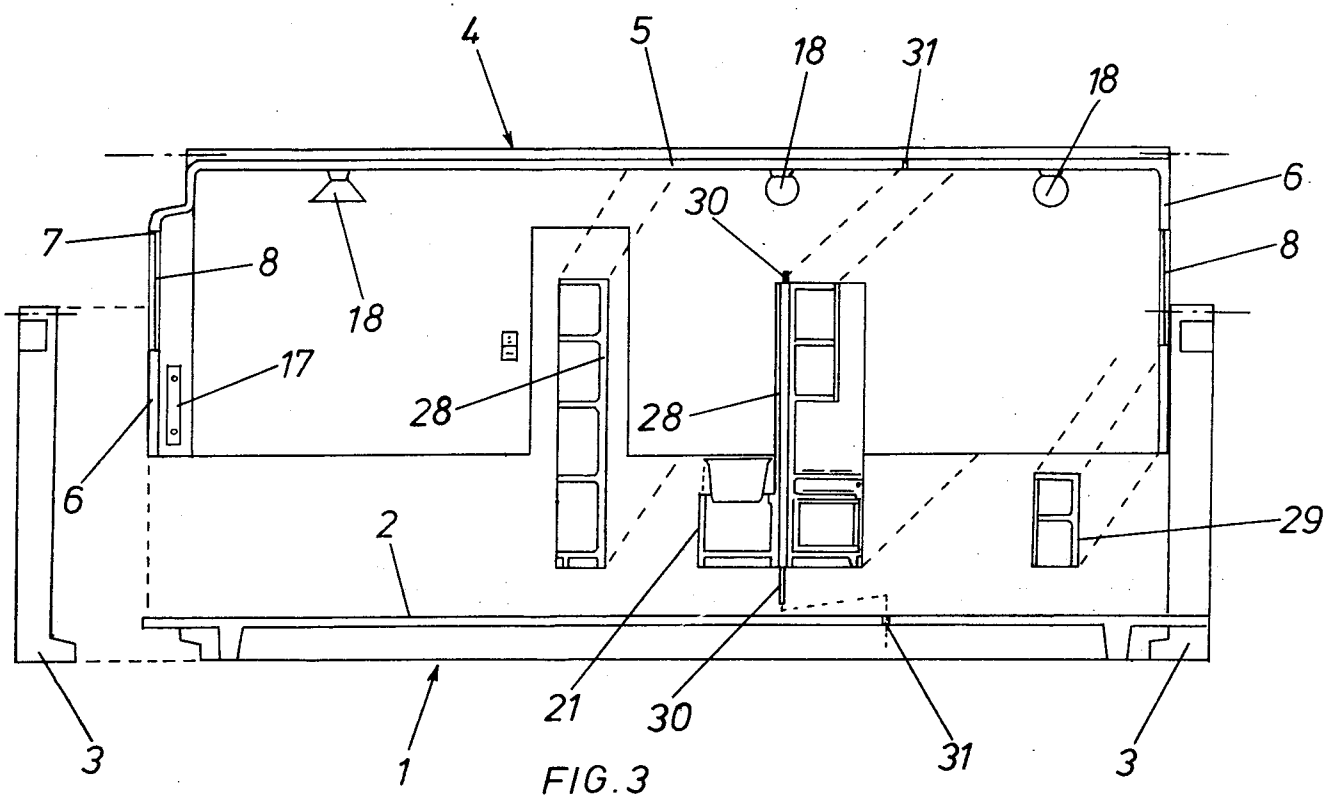
Figure 4:
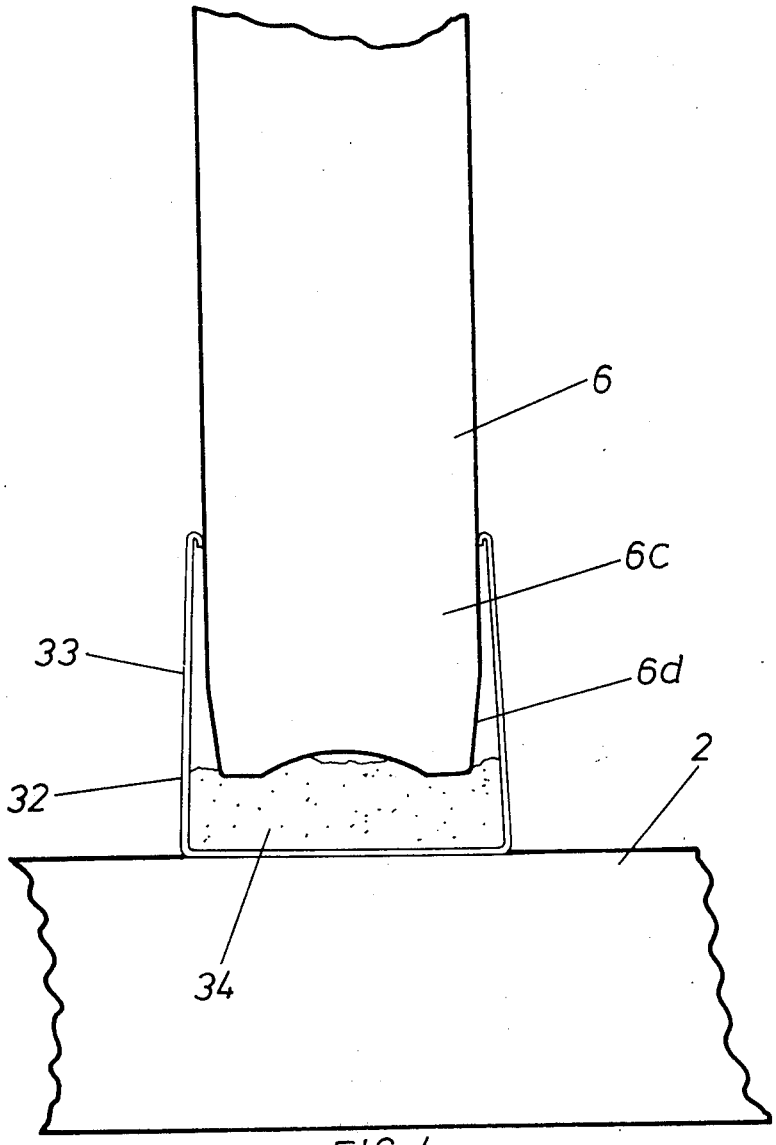
Figure 5:
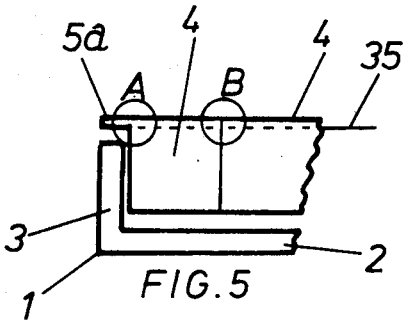
Figure 6:
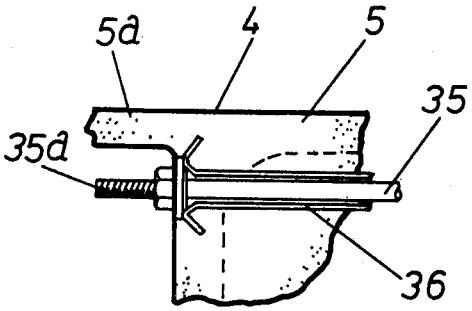
Figure 7:
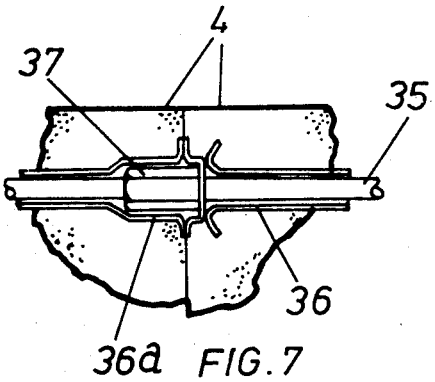
Figure 8:
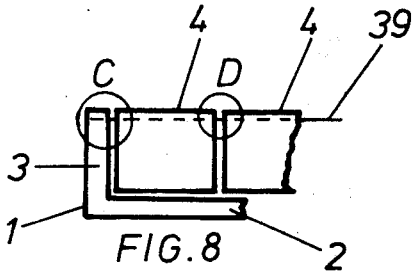
Figure 9:
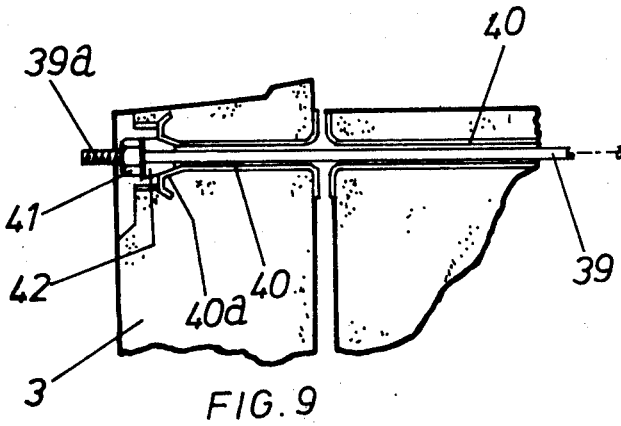
Figure 10:
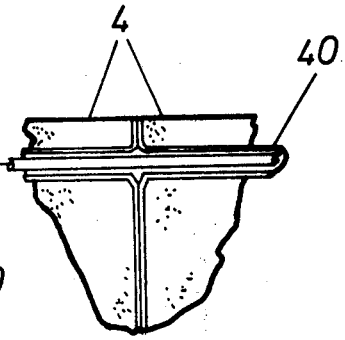
Figure 11:
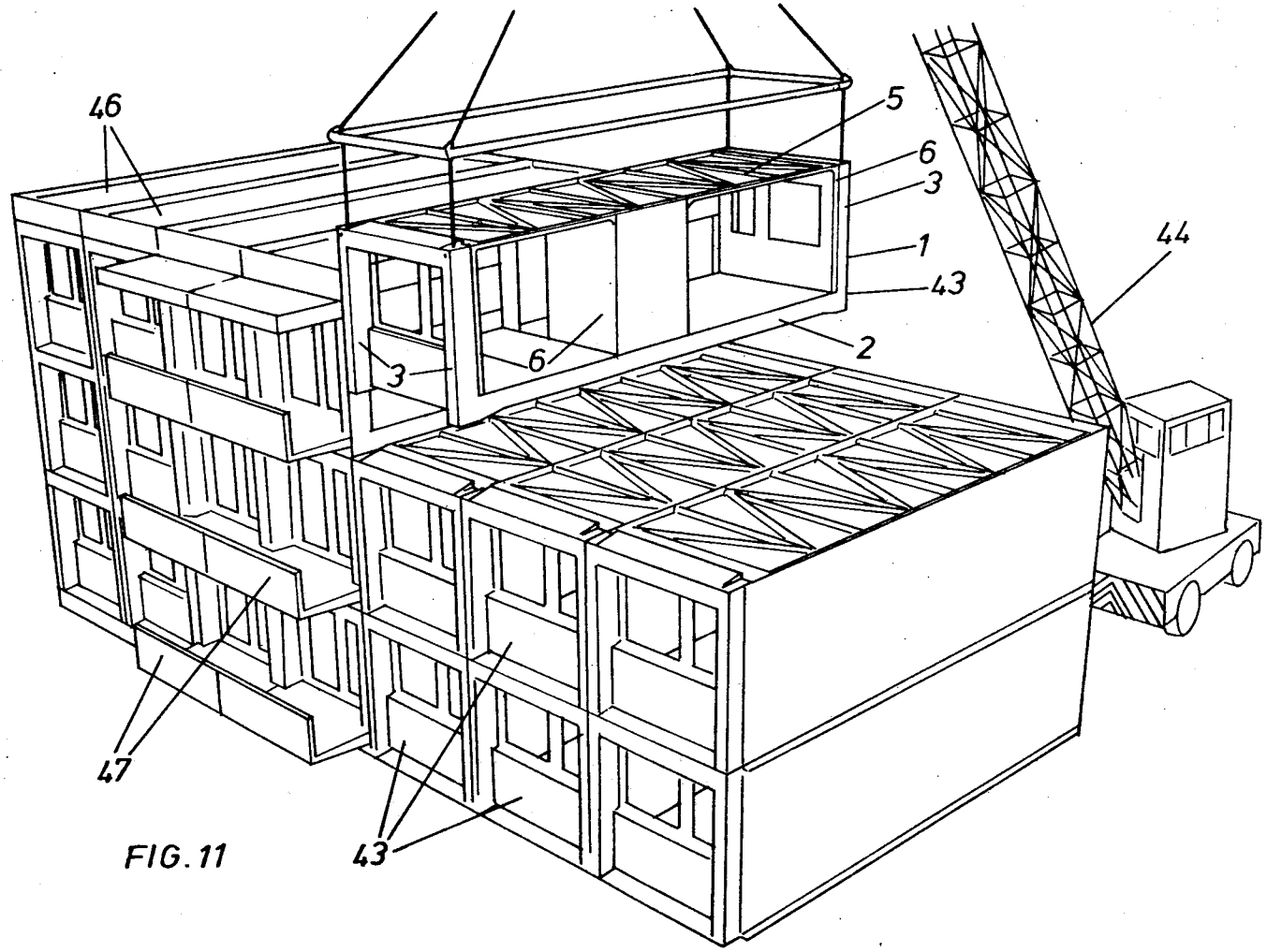

In order that the invention may be the more readily understood reference will hereinafter be made, by way of example, to the accompanying drawings, in which:

FIG. 1 is an exploded side sectional elevation of one embodiment of a room element according to the present invention, FIG. 2 is an exploded side sectional elevation of another embodiment of a room element according to the present invention, FIG. 3 is an exploded side sectional elevation of yet another embodiment of a room element according to the present invention, FIG. 4 is a fragmentary detail view showing a preferred form of joint between the floor panel structure of a load-bearing frame or chassis and a wall of a cell unit, FIG. 5 is a diagrammatic view showing one method of assembling a room element according to the present invention, FIG. 6 is a fragmentary view of an enlarged scale of that part of FIG. 5 enclosed in circle A, FIG. 7 is a fragmentary view of an enlarged scale of that part of FIG. 5 enclosed in circle B, FIG. 8 is a diagrammatic view showing another method of assembling a room element according to the present invention, FIG. 9 is a fragmentary view on an enlarged scale of that part of FIG. 8 enclosed in circle C, FIG. 10 is a fragmentary view on an enlarged scale of that part of FIG. 8 enclosed in circle D, and FIG. 11 is a perspective view of a plural storey building according to the invention which is in the course of construction and showing a room element being lowered into position.

The room element illustrated in FIG. 1 comprises a load-bearing frame or chassis 1 comprising a floor panel structure 2 and vertical load-bearing structures 3 and three cell units 4*a*, 4*b*, 4*c*, each comprising a ceiling or roof 5, and vertical walls 6 formed integrally with the ceiling or roof 5.

The floor panel structure 2 and vertical load-bearing structures 3 of the load-bearing frame or chassis 1 are formed by casting from reinforced concrete. The cell units 4 are formed by casting from a fireproof castable building material of the kind hereinbefore described.

The walls 6 of cell units 4 are formed with such openings for windows 8 and with such openings 9 for doors (not shown) as are required. The cell units 4*a* and 4*c*, which are a living or dining room unit and a kitchen unit respectively, each comprises a window niche 10 and integral shelves 11 which may be provided with doors 12 to form cupboards. In the kitchen unit 4*c*, an integral shelf 13 provides a work surface 14 upon which are provided cooking rings 15. Beneath the shelf 13 is an oven 16. The upper surface 11*a* of a shelf 11 of the kitchen unit 4*c* provides a work surface.

Pipes and conduits for services such as water, electricity and gas are incorporated in the cell units 4 during the casting thereof as are junction boxes or connections for heating means 17, light fittings 18 and switches and power points 19. Alternatively, or in addition, channels or recesses may be provided during casting for the reception of pipes and conduits and any required fixtures and fittings.

The cell unit 4*b* is a wet cell unit, e.g., is a bathroom unit, and comprises a floor portion 20 formed integrally with the walls 6 thereof. Floor portion 20 includes a trough 21 for the reception of a bath 22.

The ceilings or roofs 5 of the cell units 4 are reinforced by longitudinally extending intergral ribs 23. Likewise floor panel structure 2 is reinforced by longitudinally extending ribs or beams 24 and by laterally extending ribs or beams 25.

The cell units 4 may be substantially completely finished, i.e. fitted and decorated, prior to assembly with the load bearing frame or chassis 1.

Assembly is effected by positioning the cell units 4 on the floor panel structures 2 as indicated by broken lines. Thereafter the cell units 4 are connected to one another and to the vertical load bearing structures 3 by suitable structural means such as post-tensioning means 26 extending through passages provided in the reinforcing ribs 23 of cell units 4 and through apertures in the vertical load bearing structures 3. The vertical load bearing structures 3, which in the present instance comprise two columns or pillars at each end of the floor panel structure 2, may be assembled with the floor panel structure 2 either before or after the positioning of the cell units 4 on the floor panel structure 2. The vertical load bearing structures 3 are connected to the floor panel structure 2 as by means of structural means such as post-tensioning means extending through channels in the reinforcing ribs or beams 24 of floor panel structure 2 and through apertures in the load bearing structures 3.

If desired floor covering 27 may be provided on the upper surface of floor panel structure 2 prior to the assembly of the cell units 4 therewith. Preferably such floor covering 27 has a protective film or layer, e.g., of plastics, paper or the like, thereover which can be removed when the room element or the building in which it is installed is complete or substantially complete and which protects the floor covering from being soiled or damaged by workmen.

In the embodiment shown in FIG. 2, in which like parts have been given like reference numerals, the room element comprises only a single cell unit 4 which comprises a living or dining region 4*d*, a bathroom region 4*e* and a kitchen region 4*f*. A prefabricated partition wall and shelf unit 28, which may be cast from a fireproof castable building material as hereinbefore described, is incorporated in the living or dining region 4*d*. Partition wall and shelf unit 28 may be secured to the ceiling or roof 5 of the cell unit 4, e.g., by means of a suitable adhesive preferably of the epoxy type, or by means of bolts or other fixing means, prior to the assembly of the cell unit with the load bearing frame or chassis 1 or may be secured to the floor panel structure 2 prior to the assembly of the cell unit 4 with the load bearing frame or chassis 1 or may simply be sandwiched between the ceiling or roof 5 and floor panel structure 2 during the assembly of the cell unit 4 with the frame or chassis 1. The floor portion 20 of bathroom region 4*e* is cast separately and is assembled with the cell unit 4 in any suitable manner. Likewise end wall 6*a*, which when the room element is incorporated in a building is intended to be an exterior wall, is cast separately and is assembled with the frame or chassis 1 prior to the assembly of the cell unit 4 with the frame or chassis 1. This enables a "warm" construction wherein the vertical load bearing structures 3 are contained within the building and are thermally insulated against changes in outside temperature so that they are not so subject to expansion and contraction. End wall 6*a* may incorporate cupboard recesses 6*b* as shown.

The arrangement shown in FIG. 3, in which again like parts have been given like reference numerals, is similar to that shown in FIG. 2 except that all interior partition walls are provided by prefabricated partition wall and shelf units 28. Likewise, in the kitchen region 4*f* the worktop and cupboard unit 29 is a prefabricated unit which may again be cast from a fireproof castable building material as hereinbefore described. The partition wall and shelf units 28 may be provided with tongue or spigot portions 30 adapted to engage in grooves or sockets 31 in the floor panel structure 2 and ceiling or roof 5.

FIG. 4 shows a preferred method of effecting a joint between the walls 6 of the or each cell unit 4 and the floor panel structure 2 and according to which a channel-section member 32 is secured to the floor panel structure 2 and receives between its upstanding side walls 33 the lower margin 6*c* of a wall 6. Channel-section member 32 may be formed from any suitable material e.g., metal. Preferably the arrangement is such that the side walls 33 of the channel-section member 32 will be sprung-apart slightly when the wall 6 is engaged therebetween so that the upper inturned margins of the side walls 33 firmly engage the wall 6. To facilitate the engagement of the lower margin 6*c* of wall 6 in the channel-section member 32, the lower margin 6*c* of wall 6 is chamferred as shown at 6*d*. A suitable sealing or bonding medium 34 is inserted in the bottom of the channel-section member 32 before the lower margin of wall 5 is engaged therein so that the medium 34 will be displaced around the sides of the lower margin of wall 6. Such sealing or bonding medium may be an inelastic medium such as cement mortar if no movement is required in the joint or may be a medium having at least some elasticity, e.g., a rubber or plastics based compound, if some movement is required in the joint.

Channel-section member 32 may be secured to floor panel structure in any suitable manner as by means of bolts, gun-nailing or other suitable fixing means or by means of a suitable adhesive. Where a floor covering is to be applied to floor panel structure 2 prior to the assembly of the cell unit(s) 4 therewith, then such floor covering may be laid on the floor panel structure 2 prior to the securing of the channel-section member 32 to the floor panel structure 2.

The cell units 4 may be connected together in assembled relationship prior to being assembled with the frame or chassis 1 as shown in FIGS. 5, 6 and 7, or may be assembled with the frame or chassis 1 and then connected together and to the vertical load bearing structure 3 as shown in FIGS. 8, 9 and 10.

Referring first to FIGS. 5, 6 and 7 it will be seen that the cell units 4 are assembled together by post-tensioning cables 35 (only one of which is shown) which extend through conduits 36 embedded, e.g., cast, in the cell units 4. Each cell unit 4 is provided with a section of the post-tensioning cable 35 and these sections are connected together at the time of assembly by nuts 37 which are housed in enlarged portions 36*a* of conduits 36 and which engage screw-threaded end portions of the cable sections. A nut 38 is provided at each outer end of the cable 35 whereby the cable can be tensioned or can be anchored after it has been tensioned using hydraulic or other suitable means. Any excess portion 35*a* of the cable which protrudes beyond the nut after the nut has been tightened can be cut-off. The ceiling or roof 5 of the cell units 4 at each end of the assembly may be extended to provide an overhanging portion 5*a* which extends over the vertical load bearing end structures 3 of the frame or chassis 1.

In the method shown in FIGS. 8, 9 and 10, the cell units 4 are assembled with the frame or chassis 1 and are then connected together and to the vertical load bearing structures 3 of the frame or chassis 1 by post-tensioning cables 39 (only one of which is shown) which extend through conduits 40 provided e.g., cast, in the structures 3 and cell units 4. Each cable 39 has a screw-threaded portion 39*a* at each end thereof which is engaged by a nut 41 and collet jaws 42 which are received in a tapered entry portion 40*a* of the conduit 40 in the structure 3 so that as the nut 41 is tightened to tension the cable the collet jaws 42 will be urged into gripping engagement with the cable 39.

FIG. 11 shows a plural storey building according to the present invention in the course of construction. As will be seen the building comprises a plurality of room elements 43 which have been mounted face-to-face and one upon another to form the building. A room element 43 is shown being lowered into position by means of a crane 44.

It will be observed that the columns or pillars comprised in the load bearing structures 3 of superimposed room elements are in vertical register so that the frame or chassis of each upper room element is supported by the columns or pillars of the next lower room element. The left-hand side of the Figure shows roof members 46 overlying room elements of an upper storey. It will also be seen that some of the room elements have a balcony 47.

It will be readily appreciated that the forming of the cell units 4 by casting is more compatible with factory production techniques than conventional building fabrication methods. Moreover, ready access can be had to the cell units, either from below or by turning the cell units into a suitable disposition such as onto their sides, for finishing operations such as glazing, door hanging, the fitting of light fixtures, plumbing, etc. If desired the cell units can be manufactured at a different factory or location from that at which the room element is assembled. Thus, where the room element comprises a plurality of cell units, the different cell units such as the kitchen unit and bathroom unit can be manufactured in specialist factories.

What we claim is:

1. A method of constructing a transportable prefabricated room element comprising:

a. preparing a load-bearing floor panel structure providing a horizontal floor surface;

b. preparing at least one load-bearing vertical structure;

c. preparing at least one prefabricated self-supporting cell unit comprising a ceiling member and at least one full height wall member depending from the ceiling member, and d. assembling the prefabricated self-supporting cell unit and the load-bearing vertical structure to the floor panel structure by joining the depending wall member to the horizontal floor surface and joining the load-bearing vertical structure to the floor panel structure and to the cell unit at a factory remote from a building site.

2. A method of constructing a transportable prefabricated room element according to claim 1 including the step of joining the depending wall member to the horizontal floor surface by mounting a channel member on the floor surface and inserting the lower end of the depending wall member into the channel member.

3. A method of constructing a transportable prefabricated room element according to claim 2 including the step of inserting a sealing material into the channel member before inserting the lower end of the wall member into the channel member.

4. A method of constructing a transportable prefabricated room element according to claim 1 wherein the ceiling member of the cell unit is formed with at least one passage and including the step of joining the cell unit to the load-bearing vertical structure by inserting a post-tensioning member through the passage and connecting it to the vertical structure.

5. A method of constructing a transportable prefabricated room element according to claim 1 including the step of preparing the prefabricated self-supporting cell unit by casting a fireproof castable building material in a mold to produce a cell unit having integral wall and ceiling members.

6. A method of constructing a transportable prefabricated room element according to claim 1 including the step of assembling a plurality of self-supporting cell units and two load-bearing vertical structures to the floor panel with the cell units disposed in laterally abutting relation between the two vertical load-bearing sructures.

7. A method of constructing a building from a plurality of transportable prefabricated room elements comprising prefabricating each of a plurality of room elements by:

a. preparing a load-bearing floor panel structure providing a horizontal floor surface;

b. preparing at least one load-bearing vertical structure;

c. preparing at least one prefabricated self-supporting cell unit comprising a ceiling member and at least one full height wall member depending from the ceiling member;

d. assembling the prefabricated self-supporting cell unit and the load-bearing vertical structure to the floor panel structure by joining the depending wall member to the horizontal floor surface and joining the load-bearing vertical structure to the floor panel structure and to the cell unit at a factory remote from a building site;

e. transporting the plurality of room elements to a building site, and f. mounting the elements in face-to-face relation to form a building.

8. A method of constructing a building according to claim 7 including the step of mounting some of the plurality of room elements with their vertical load-bearing structures vertically aligned with and in supporting relation to the vertical load-bearing structures of other room elements to form a multistorey building.

* * * * *